US005906076A

United States Patent [19]

Mc Manus

[11] Patent Number: 5,906,076

[45] Date of Patent: May 25, 1999

[54] REMOVABLE SUPPORT FOR CONCRETE SLAB CONSTRUCTION AND METHOD

[75] Inventor: Ira J. Mc Manus, Florham Park, N.J.

[73] Assignee: Mc Manus Design Group, Inc., Florham Park, N.J.

[21] Appl. No.: 09/041,944

[22] Filed: Mar. 13, 1998

[51] Int. Cl.[6] ..... E04B 1/18

[52] U.S. Cl. ..... 52/126.5; 52/126.7; 52/360; 52/354; 52/414; 249/188; 249/210; 249/211; 249/23

[58] Field of Search ..... 52/357, 359, 360, 52/354, 355, 126.5, 126.7, 414; 249/188, 210, 211, 23, 19

[56] References Cited

U.S. PATENT DOCUMENTS

| | | | |
|---|---|---|---|
| 317,072 | 5/1885 | Ackerson | 249/23 |
| 2,381,635 | 8/1945 | Baker | 72/46 |
| 2,508,635 | 5/1950 | Badt | 249/23 |
| 2,974,386 | 3/1961 | Frost | 249/211 |
| 3,113,402 | 12/1963 | Butler | 52/414 |
| 3,630,479 | 12/1971 | Sullivan | 249/19 |
| 3,738,602 | 6/1973 | Arnett | 249/23 |
| 3,806,074 | 4/1974 | Ward | 249/23 |
| 3,954,248 | 5/1976 | Barber | 249/211 |
| 4,192,623 | 3/1980 | Borg | 249/211 |
| 4,335,557 | 6/1982 | Morton | 52/414 |
| 4,349,491 | 9/1982 | Eyden | 249/210 |
| 4,751,803 | 6/1988 | Zimmerman | 52/414 |
| 5,564,235 | 10/1996 | Butler | 249/210 |

FOREIGN PATENT DOCUMENTS

| | | | |
|---|---|---|---|
| 368298 | 3/1963 | Switzerland | 249/184 |

*Primary Examiner*—Christopher Kent
*Assistant Examiner*—Phi Dieu Tran A
*Attorney, Agent, or Firm*—W. Patrick Quast, Esq.

[57] ABSTRACT

A removable support structure for concrete slab fabrication is described. A latch device secured to the ends of both shoring girders and shoring beams permits rapid and accurate placement of the shoring support across a span to be structured in concrete. Vertical shoring posts and supports are eliminated, with the added advantage of the plane of the shoring always being automatically in the plane of the floor being formed. Bearing shoes on the ends of corrugated deck members, secured to building girders, cooperating with straps at their other ends, accurately and securely positions the corrugated decking in place. After the concrete has hardened, the entire support structure, including the shoring girders, shoring beams, and corrugated deck members, are rapidly and efficiently removed, ready for re-use.

14 Claims, 8 Drawing Sheets

REMOVABLE SUPPORT FOR CONCRETE SLAB CONSTRUCTION AND METHOD

BACKGROUND

This invention relates to the construction of concrete slabs, and in particular to a support structure that is rapidly and efficiently put in place, and rapidly and efficiently removed in condition for re-use.

Concrete slab construction is, of course, a routine method for horizontally covering open areas between columns and girders affixed to the walls of buildings, parking garages, and so on. A typical procedure for installing these concrete "floors" is to first place shoring members across the columns and girders, with shoring support posts rising from the ground or the deck below to the concrete floor being installed. Corrugated decking is then placed on the surface of the shoring, with the edges of the decking overlapping flange edges on the permanent building wall, girders and columns. Post-tensioning steel cables are then placed over the decking to add strength to the resultant structure. Wet concrete is then poured over the corrugated decks. Alternately the post tensioning cables can be placed in the wet concrete as opposed to prior to the pouring. The concrete is then allowed to harden over a period of time. The supporting members can be so designed as to be removable after the concrete has hardened, simplifying concrete slab maintenance, and permitting re-use of the support structure on additional floors.

Various methods have been proposed for removable concrete slab support systems as is evident from the following examples. Keppler, in U.S. Pat. No. 1,707,226, discloses a supporting structure for concrete construction. This invention teaches a height adjustable shore 12 (centering post) cooperating with flanged 18 sheet metal members 16 (corrugated decking) connecting to height adjustable recesses 21 in soffit chairs. The invention notes (col. 2, lines 01–109), "[a]fter the concrete has been sufficiently set, the shoring may be removed and the ledgers taken down, whereby the centering forms with the soffit chairs may be removed and permanent shoring mounted in place to engage the soffit plates or boards for continuing to support the concrete until it is firmly set with full strength". Lutz, in U.S. Pat. No. 3,059,738, discloses a removable concrete slab support wherein a portion of the support may be removed for the sake of economy prior to the concrete being fully set. An intermediate support 2 upheld by a prop 3 holds concrete slab supporting girders 1 and end supports 4 in place during the initial phase of setting wet concrete. Cornell, in U.S. Pat. No. 4,856,252, discloses a joist hanger 10 for removably securing a joist 38 during concrete slab construction. The joist hanger 10 has a box like metal configuration for securing the end of a suitable joist in the hanger. The joist hanger 10 has an extension section 18 for overlapping the top surface of a wall or girder 52, with a roll bar 22 acting as a pivot located a spaced distance below the extension section. After a concrete slab 34 is solidified on as suitable support 36, a sharp blow to the hanger causes it to pivot on roll bar 22, thereby releasing the hanger 10, joist, and support form the hardened concrete slab.

While these devices and methods disclose useful details for installation and removal of concrete slab support systems, they do not envision the efficiencies and conveniences inherent in the present invention. As will be more fully discussed below, this invention discloses a removable structure and method for supporting wet concrete during concrete slab construction without making use of vertical posts or shoring members which have to be supported down through the floors below to the ground. Accurate set up of corrugated decks is quickly accomplished to accept wet concrete. After the concrete has hardened all support members are quickly removed, ready for re-use as required.

It is therefore a primary object of the invention to provide a removable structure for supporting concrete slab construction that can be quickly put in place prior to the pouring of wet concrete, and quickly removed in re-usable condition after the concrete has hardened.

A further object of the invention is to eliminate the necessity for using vertical posts or shoring members which would have to be supported down through the floors below to the ground.

Another object of the invention is to permit the pouring and forming of a number of levels of concrete slabs in any desirable sequence.

Still another object of the invention is to provide for the plane of the shoring to always be automatically in the plane of the floor being formed.

Yet another object of the invention is to provide for rapid and convenient adjustment of the thickness of the concrete slab being formed.

A further object of the invention is to eliminate the necessity for permanently affixing structural support members to each other.

An additional object of the invention is to provide for most efficient placement of steel tendons within the concrete if post tensioning reinforcement concrete slab production is employed.

SUMMARY

These and other objects are obtained by the removable concrete slab construction and method of the present invention.

As has been noted above, in building construction, concrete floors are routinely installed horizontally between permanent building columns and girders supporting the walls of the building. Wet concrete is poured over usually temporary corrugated decking erected between the building girders and columns. Typically shoring posts are required, the posts extending vertically from the ground or a previously formed floor, in order to support the temporary shoring. For a variety of reasons, including economy in building construction and ease of maintenance of the finished building, removal of the corrugated decking, temporary shoring, and vertical post supports is desirable.

I have found that concrete floors can be constructed faster and more efficiently by eliminating any necessity for temporary vertical shoring supports. This permits forming floors at any convenient level without concerns regarding foundation supports for temporary shoring. In addition, my method provides for precise, accurate placement of temporary supports in that when all elements are positioned they are all in their proper location with minimal field measuring or adjusting.

For example, my method makes use of a right angle grid of shoring girders and shoring beams positioned between the permanent steelwork comprising the building columns and girders. The shoring girders and shoring beams can be constructed from conventional steel "I" beams with their ends modified with a latch device which allows insertion into a support for quick erection, adjustment, and removal. The purpose of the shoring girders is to provide support for the shoring beams, with the shoring beams providing the support for the corrugated decks. Conventional corrugated decking is employed with the exception that the ends of the decking to be supported by the building "I" beams have a bearing shoe added to the closed end of the corrugated decking to facilitate removal from the hardened concrete which will be more fully described below. The bearing shoe also prevents vertical displacement of the decking due to wind and other construction forces. The bearing shoe further allows exact bearing length of the decking over the building girder. Locking straps, placed at the opposite end of the decking to be supported by the shoring beams, complete the precise, accurately secured concrete slab, construction support system.

To construct a concrete floor, the end latches on the shoring girders are secured in pre-cut holes in the permanent building girders and/or columns, with the latches then being firmly secured so as to lock the shoring girders accurately in place. Similarly shoring beams are quickly secured at right angles to the shoring girders again making use of pre-cut holes in the shoring girders to which the end latches on the shoring beams are secured. Corrugated decking is then positioned perpendicular to and between the permanent girders and the shoring beams, with the bearing shoe end of the deck engaging a top flange edge of the permanent girder, and with the opposite end of the deck, overlapping the end of a second corrugated deck, and being held in position by locking straps, all supported by the shoring beams. The locking straps secure the open ends of the decking together, and also insure that the bearing shoe end of the deck is held firmly in place against movement caused by workers or the elements, as well as facilitating removal of the decking.

With the removable support structure now quickly, accurately, and firmly in place the wet concrete can be poured onto the surface of the corrugated decks with reinforcement rods inserted, if required. For those applications requiring post tensioning of the concrete, steel tendons can now be placed not only above the furrows of the decking, but also within the furrows. The more favored placement of steel tendons is possible here where the decking is secured perpendicular to the permanent girders, and not parallel thereto, which is typical in existing concrete slab construction. After the concrete has hardened sufficiently to be self supporting, the complete removable support structure is quickly removed, all components being ready for re-use. The latch mechanism on the shoring girders and shoring beams is simply retracted and the shoring girder or beam lowered on the threaded latch, retracted and moved to the right, permitting removal from below the decking. The bearing shoe construction now permits the decks to be quickly removed from the cured concrete by simply lowering the open ends and rocking them in a downward direction, which movement can be facilitated by making use of the locking straps which had previously been holding the decks in place. The shape of the shoe end allows the rocking motion to break the deck free of the hardened concrete.

Thus a new convenience in forming concrete slabs in buildings, parking garages, and the like is disclosed. A wet concrete support structure is described which is set in place with heretofore unobtainable speed and efficiency. Vertical support posts for the shoring are completely eliminated, permitting flooring levels to be constructed in any convenient sequence, while at the same time assuring that the shoring is always automatically in the plane of the floor being formed whether level or on a slope as in ramped floors. The perpendicular placement of the corrugated decks also permits placement of post tensioning steel tendons in the most favored position for strengthening the concrete. While the shoring girders and shoring beams have been described as preferably being modified steel "I" beams, it is to be noted that other shoring materials, including wood, plastic, and concrete, can be similarly employed.

DETAILED DESCRIPTION

Figure 1:
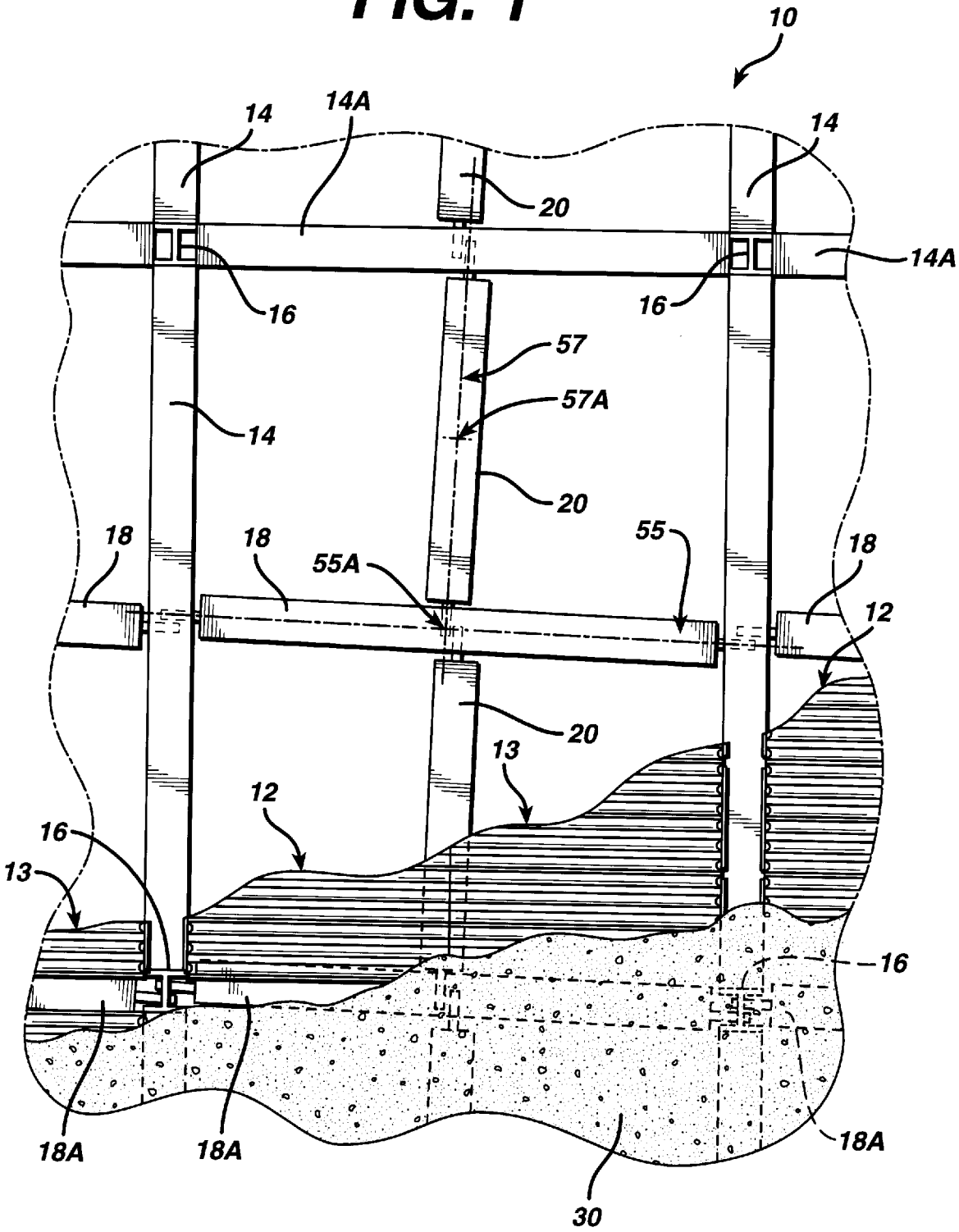
FIG. 1 is a schematic representation of a floor framing plan for one version of the invention.

Turning now to the drawings wherein like structures having the same function are referred to with the same numerals, in FIG. 1 a floor framing plan 10 according to the invention is shown. Building columns 16 and girders 14 form the permanent structural elements for holding up the walls of a building, parking garage, and the like. Shoring girders 18 are shown schematically as spanning the horizontal distance between oppositely positioned building columns 16, or girders 14. Shoring beams 20 also shown schematically interconnect the shoring girders 18, and are spaced approximately equidistant and parallel to the girders 14, spanning between the opposed walls of the building. Reference numerals 14A and 18A show permanent and shoring girder members positioned between respective columns 16. Either can be used as the concrete support system design dictates. The shoring girder design, 18A, similar to shoring girder 18, has a suitable interface at each respective column to accept the latch portion of the latch engaging means as described generally hereinafter.

Corrugated decks 12 are shown positioned perpendicular to the permanent girders, with one end of each deck being supported by a shoring beam 20, and the other end being supported by the top flange of a permanent girder or a plate attached to the top of a column. The number of individual corrugated decks is obviously not limited to two to span the entire distance between building walls. Intermediate sections of decking can be employed depending on particular building dimensions. The shoring girders and shoring beams of the invention can be standard, I-beam, steel building girders modified to have a latch device at each end as will be fully described. These shoring support members can also be fabricated in wood, plastic, or concrete. Standard steel corrugated decks can be employed as support members of the invention, modified to have a closed end 22 (FIG. 2) with bearing shoe structure 23 as will be more fully discussed.

Figure 2:
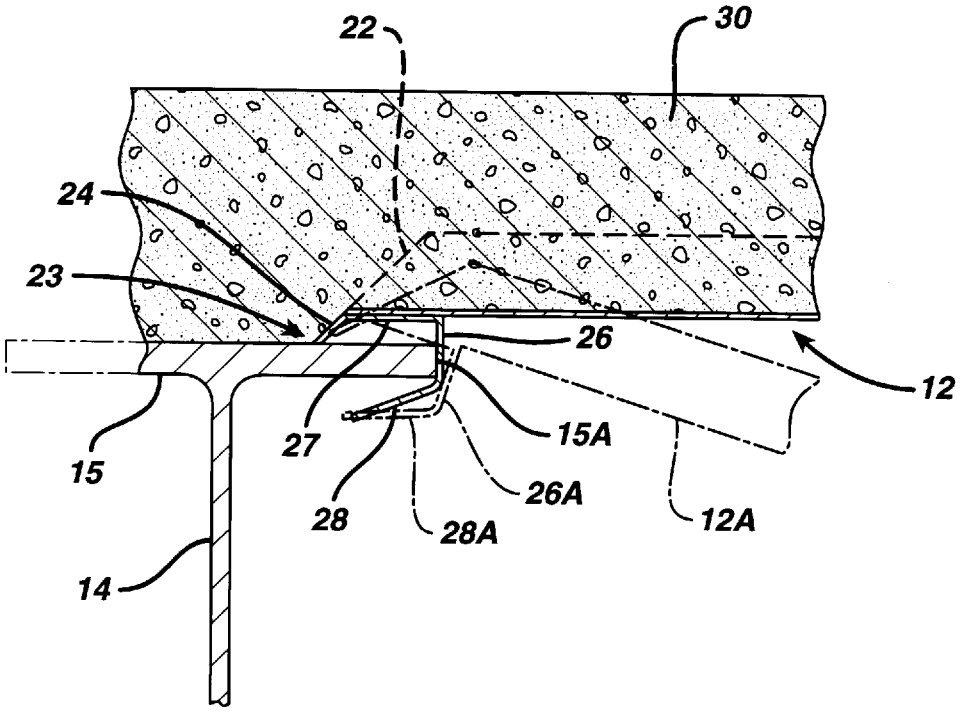
FIG. 2 is a side elevational view of one version of the invention showing the bearing shoe modified end of a corrugated deck in contact with the top flange of a permanent building girder.

In FIG. 2 the end of the corrugated deck 12 that rests on the building girder 14 is shown. Concrete 30 has been poured and hardened on the surface of the corrugated deck. Typical decks employed are normally longer in length than in width and will be so considered for the discussion of this invention. The upraised end portion adjacent each furrow 25(see FIG. 6) at this end of the deck has a metal closure plate 22 to prevent passage of concrete through the open end to avoid encasement of the deck in concrete.

A bearing shoe 23 is affixed along the width of this end of the deck and secured to its underside. It contacts a top flange 15 of a building girder. The bearing shoe is comprised of four segments: a first segment 24 angled downward from the deck underside and contacting the top surface of the flange 15; a second segment 27 affixed to the underside of the deck immediately adjacent the closed end of the deck; a third segment 26 extending downward in a generally perpendicular direction to the second segment 27, to a point just about even with the underside of the flange; and a fourth segment 28 extending under the flange 15 at an obtuse angle to the third segment. The purpose of this bearing shoe structure is to provide a means for raising the front end of the corrugated deck 12 above the top surface of the top flange 15 of the building girder to facilitate the deck's subsequent removal; and to provide a means for grasping the extended lateral edge 15A of the flange so as to accurately secure the decking in position, ready to accept the pouring of the wet concrete and to prevent accidental dislodgement by workers or the elements.

The straps 34 (FIG. 3) employed at the open, opposite end of a deck, which will be fully explained hereinafter, further insure the accurate, rigid deployment of the corrugated decks. After the concrete has hardened, the deck itself is not encased by the concrete. In FIG. 2, the deck 12A shown in phantom, together with third and fourth bearing shoe segments, 26A, 28A, shown also in phantom, illustrate the ease with which the corrugated decking 12 can be removed after the concrete has hardened by simply pivoting about the contact surface between first segment 24 and the top of the flange while rocking the deck in a downward motion.

Figure 3:
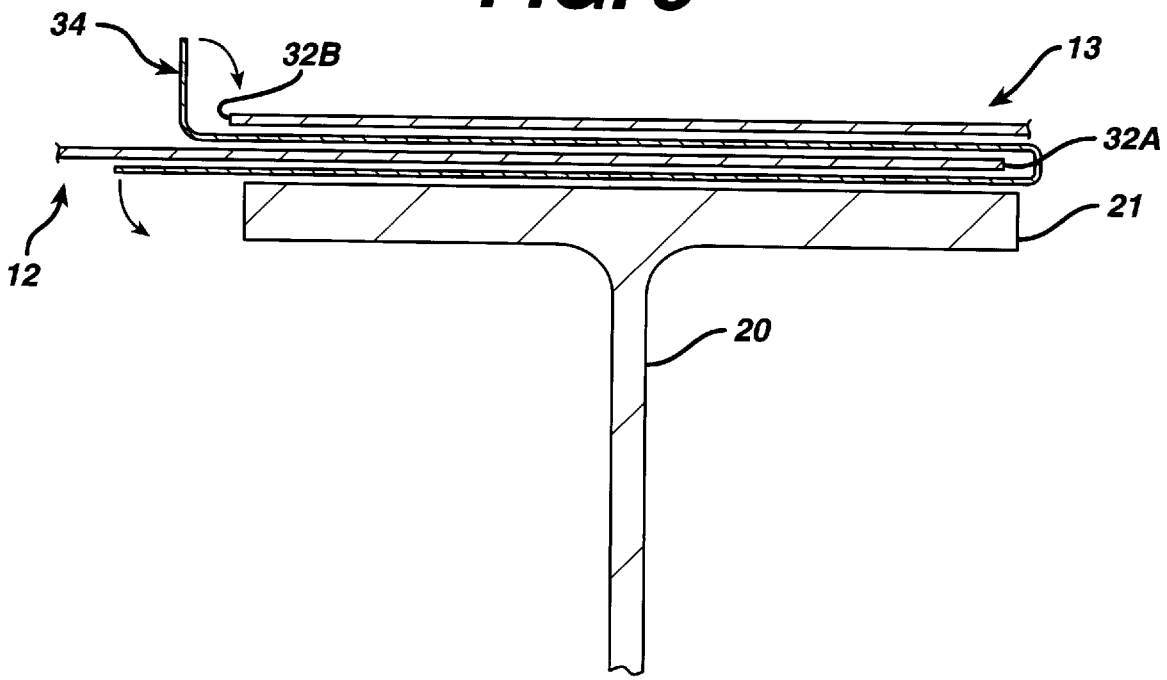
FIG. 3 is a side elevational schematic view of one version of the invention showing a strap securing the open ends of corrugated decks together.
Figure 4A:
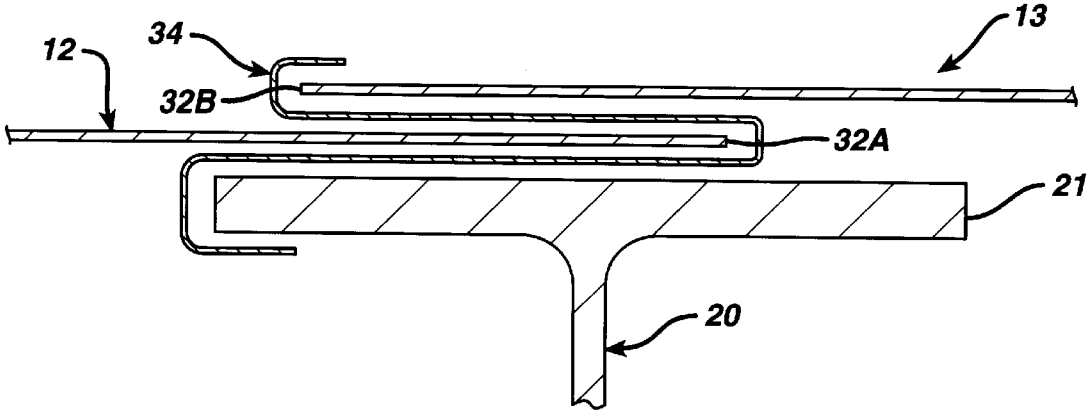
FIG. 4A illustrates a similar version of the invention shown in FIG. 3, showing the strap further securing the corrugated decks to a top flange of a shoring beam.
Figure 4B:
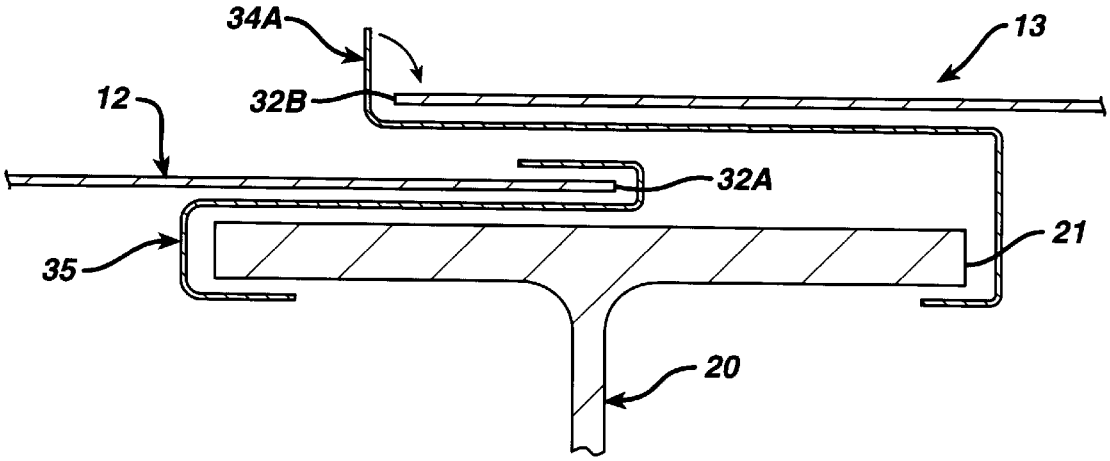
FIG. 4B illustrates a similar version of the invention shown in FIGS. 3 and 4A, additionally showing a second strap securing a corrugated deck to a top flange of a shoring beam.
Figure 4C:
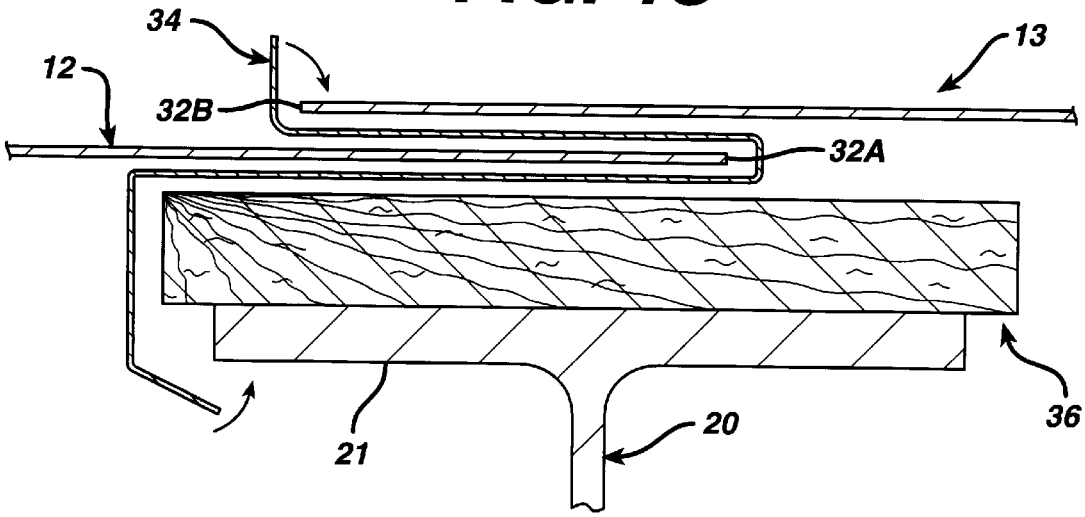
FIG. 4C illustrates a similar version of the invention shown in FIG. 3, showing a wooden platform placed on the top flange of a shoring beam for supporting the open ends of corrugated decks.

FIGS. 3–4C illustrate the strap securing method of the invention for connecting the open ends of the corrugated decks together where the decks 12, 13 overlap the shoring beams 20. In FIG. 3 a strap 34 is shown securing a first deck 12 in contact with the top surface of flange 21 of a shoring beam 20 to a second deck 13 extending in the opposite direction, and positioned at its open end directly over the first deck. The ends of the strap 34 are shown before they are bent in a downward direction as indicated by the arrows, thereby linking the two open ends 32A, 32B, of the two decks together. FIG. 4A shows the strap ends bent over the end of the respective deck sheet. Straps 34 can be made out of metal or plastic, sheet metal being preferred for its combination of strength and bendability. The straps are a few inches in width so as to fit into the furrows 25 of the corrugated decks, and of appropriate length so as to securely link the decks together. Usually one strap per deck pairing would be used, with the strap pre-hooked so as to engage the first deck 12 before the second deck unit is placed over the first deck. Before it is hammered in place to lock the decks together, the operator pulls on the strap so as to urge each deck 12, 13, away from supporting beam 20. This procedure keeps the bearing shoe end of the deck firmly and accurately secured on its girder flange 15 or column plate, and prevents dislodgement during construction due to workmen's activities, the elements, etc. The strap also assists in deck removal since the lower end of the strap can be grasped to pull the deck downward for removal.

Depending on particular building requirements different strap arrangements can be employed to provide additional security. For example, FIG. 4A illustrates bending a strap 34 to encompass not only the top and bottom positioned decks, but also the top flange 21 of shoring beam 20. FIG. 4B illustrates a double strap method: one strap 34A to secure the top deck to one side of a shoring beam top flange 21; and, a second strap 35 to secure the bottom deck to the opposite side of the same shoring beam top flange 21.

FIG. 4C illustrates utilizing a wooden platform 36 placed on the top level surface of a top flange 21 of a shoring beam for providing a platform for the placement of the open ends of the decking. The wood platform 36 comprises one or more piece(s) of plywood stacked on top of each other. The platform extends in width just beyond the top flange 21, thus providing a larger contact surface beneath the decking for a more stable condition. Further the wood is not as slippery as steel-on-steel when the decking is placed directly on the flange. Also, self-tapping screws can be used to secure corners, etc. of the decking down to the wood. Still further with the use of an appropriate thickness for the plywood piece(s), the height of the decking at the bearing shoe end 23 above the building girder top flange is compensated for at the shoring girders. As a result, the cooperating elements of the latching device disclosed hereinafter will lie essentially in the same plane. This facilitates the fabrication of substantially similar, support structure members, since the latch receiving openings are identically located in relation to the horizontal datum.

Figure 5A:
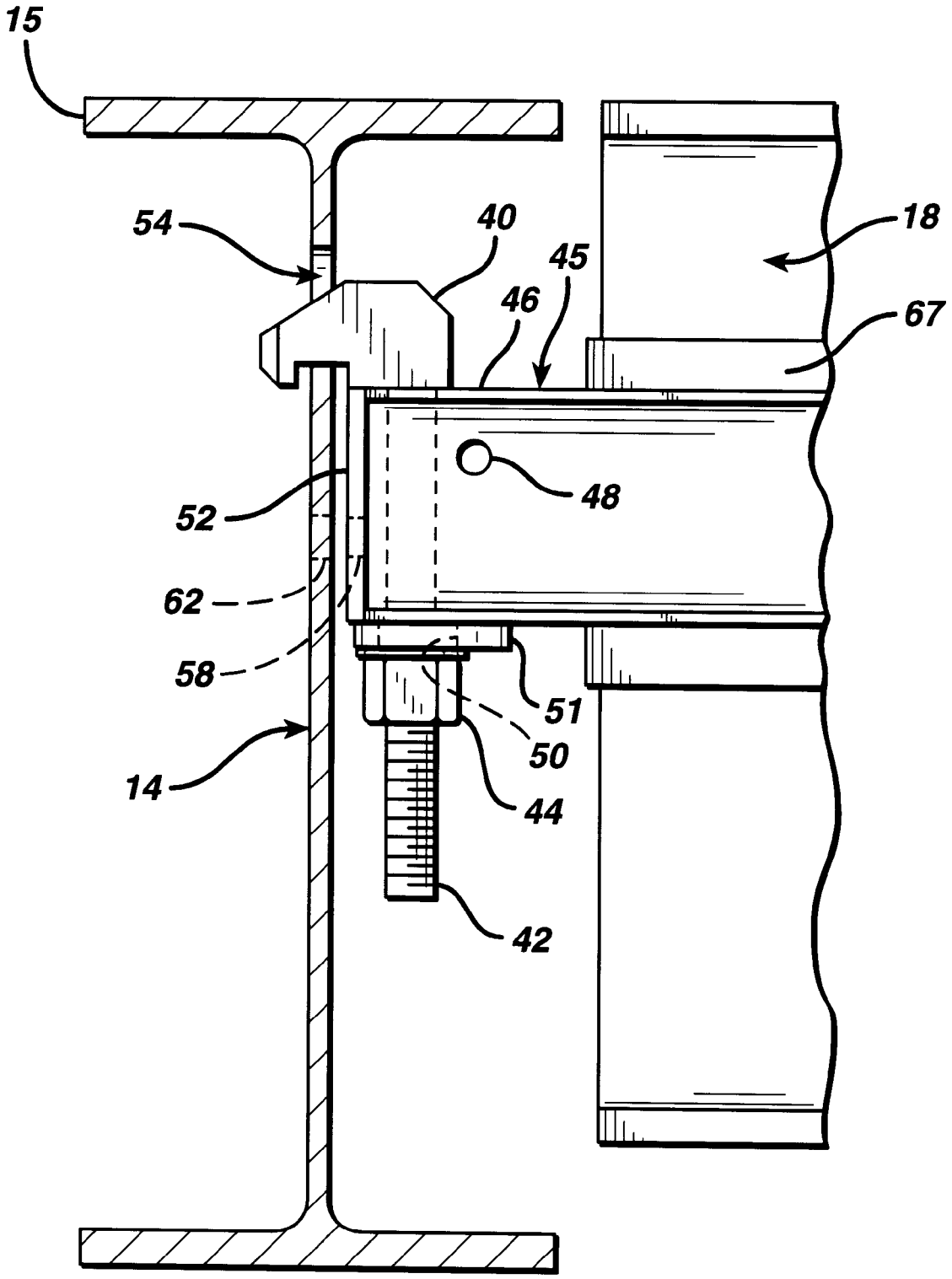
FIG. 5A is a side elevational view of one version of the invention illustrating the latch device on the end of a shoring girder engaging an opening in a permanent building girder.

FIG. 5A illustrates the latch device employed by the invention for rapid erection, adjustment, and removal of the shoring support system. A latch enclosure 45, comprised of left and right side channels 46, a front plate 52, and a base plate 51, is connected at each end of the shoring girders and shoring beams. Alternately, flat plate members can be used instead of the channels 46. The channels or flat plates can be welded or bolted to the web of the shoring member. If bolted, the parts can be easily removed and reused on other shoring members.

A latch 40 together with its threaded latch column 42 is positioned within the enclosure with the latch 40 extending above the channels 46, with the latch column 42 extending through and below the base plate 51. The base plate has a slot 50 (shown in dotted lines—FIG. 5A) to facilitate movement of the latch 40—latch column 42 during erection or removal of the support structure. A nut 44 is threaded onto the end of the latch column protruding below the base plate to raise and lower the shoring beam or girder to the appropriate height and for securing the latch in place. In FIG. 5A a shoring girder 18 is shown being connected to a permanent building girder 14, using the latch device. This same structure is employed for connection of shoring girders to building columns as well, and for connection of the shoring beams 20 to the shoring girders.

Figure 5B:
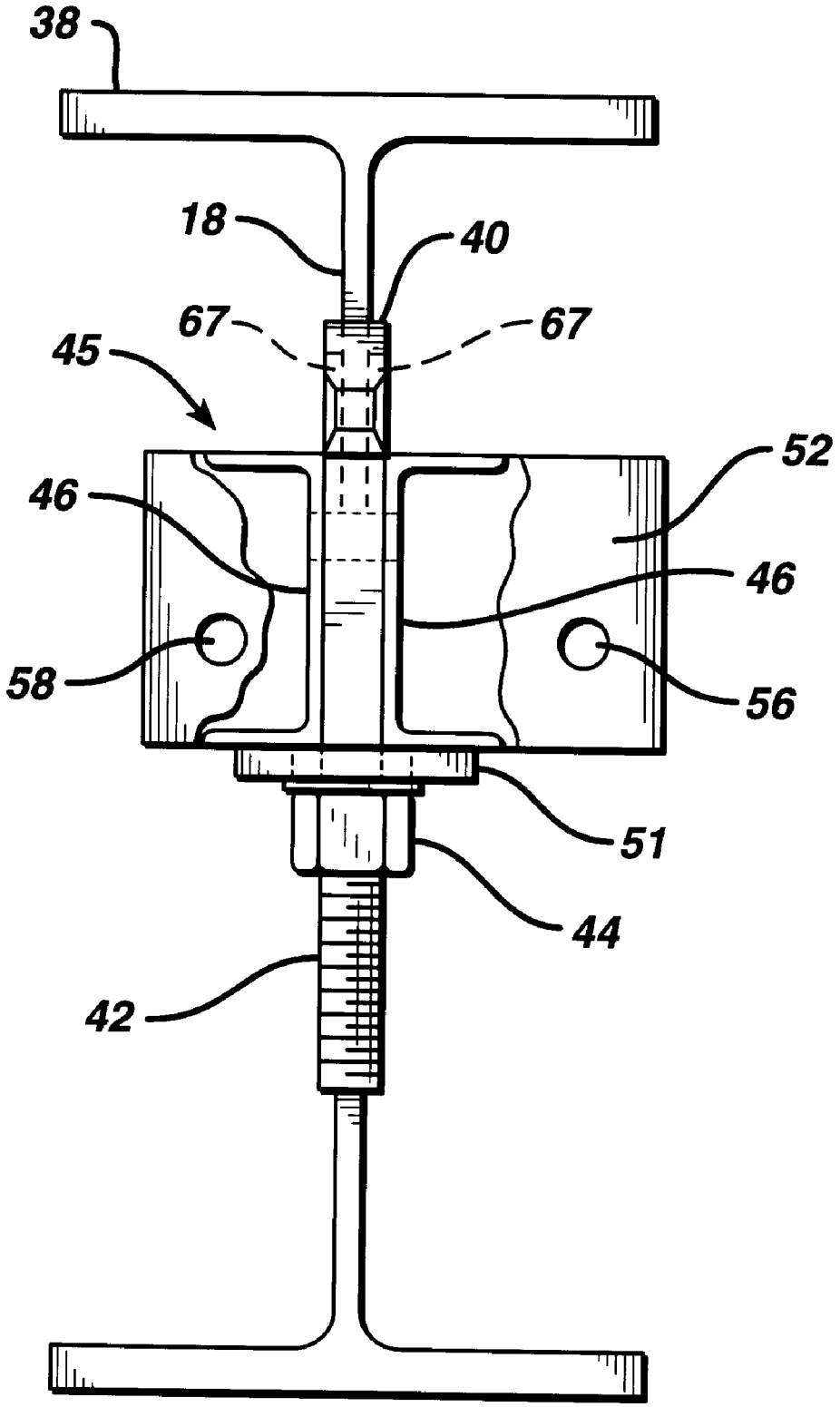
FIG. 5B is a front view of the latch device of FIG. 5A prior to the latch being secured to the opening in the building girder.
Figure 5C:
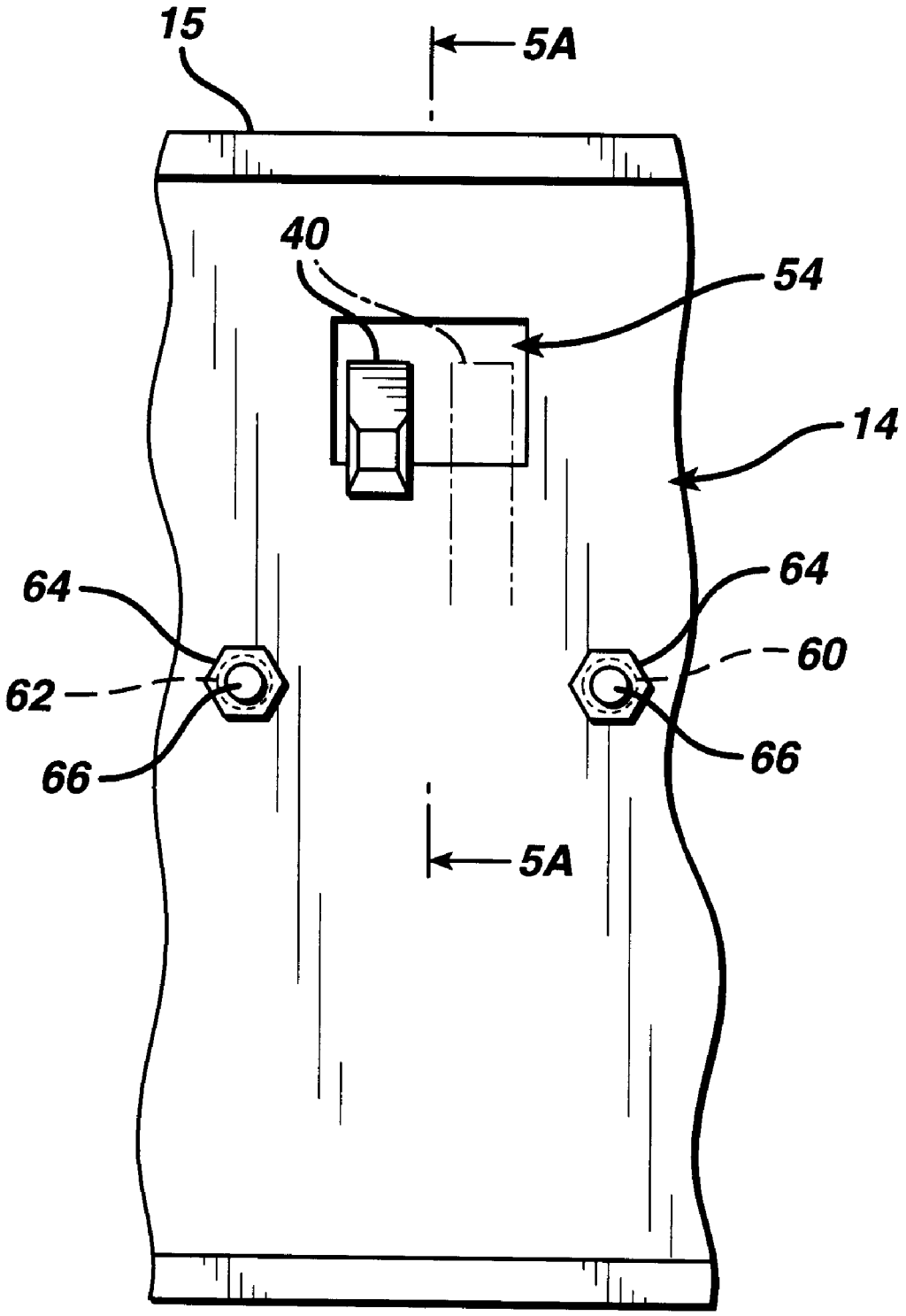
FIG. 5C is a view taken along the line 5C of FIG. 5A showing the latch device as engaged in the hole in the building girder, the latch device being further temporarily secured to the building girder by means of threaded bolts.

As best seen in FIG. 5C, an opening 54 is pre-cut in the building girder 14 into which the latch 40 on the end of the shoring girder 18 is secured. The opening 54 is made wide enough to receive two such latches, one from each side. The latch is shaped to allow easy insertion into the support hole. Facing the opening 54 from the shoring girders side the latch is always positioned to the right side of the opening in order to minimize confusion by providing uniformity during the erection procedure; and, uniformity on the positioning of the temporary bolts (66—FIG. 5C). Referring to FIG. 1, this positioning of the latch to one side results in the skewing of the members as reflected by the centerlines, 55 and 57 of respective shoring girders and shoring beams, 18 and 20. The center or middle points, 55A and 57A, of each shoring member is in its true "center" position in the beam—girder support system.

FIG. 5B illustrates a front view of the latch enclosure 45, showing temporary bolt holes 56, 58 in the front plate 52 of the enclosure. FIG. 5C illustrates the latch 40 as being secured within the opening 54 in the building girder with threaded bolts 66 passing through bolt holes 56 and 58 in the enclosure front plate, and through two matching bolt holes 60, 62 in the building girders. The temporary bolts 66 engage the end plates of two opposing shoring girders and secure the assembly to the web of the support girder with nuts 64 threaded onto the bolts. The bolts 66 are a safety feature to prevent the shoring girders and shoring beams from dislodging and moving away from the permanent girders or from each other during the pour and subsequent concrete hardening. A bolt (not shown) is secured in a bolt hole 48 positioned directly behind the latch 40 when the latch is firmly secured in the building girder opening 54. The purpose of the bolt within bolt hole 48 is to prevent any dislodgement of the latch device during construction. Spacer plates 67 can be positioned between the channels 46 and the web of the shoring girder or beam.

These provide a means to adjust the lateral position of the latch 40 in relation to the opening 54 and the latch on the opposing shoring beam or girder.

Figure 6:
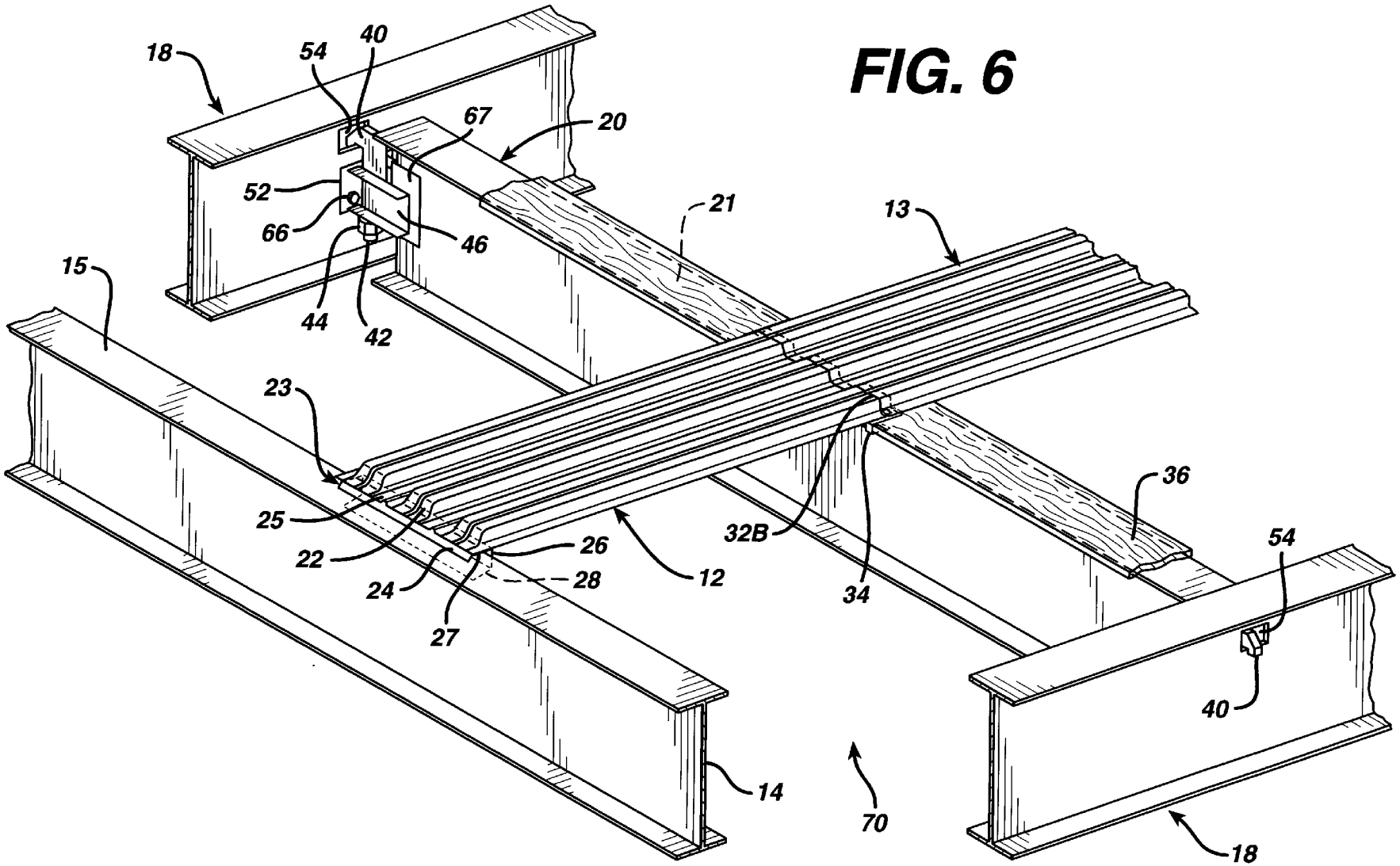
FIG. 6 is a fragmentary top plan view of one version of the complete removable support structure of one version of the invention prior to the pouring of the wet concrete.

The elements of the removable support structure 70 of the invention are shown in FIG. 6. Two sections of corrugated decking 12,13 are shown overlapping at a shoring beam 20. One of the decks spans the distance between the permanent building girders 14 and the shoring beam 20. The bearing shoe 23 at the first end of the deck envelopes the top near edge of the top flange 15 of the building girder 14. The front section 24 of the bearing shoe 23 raises the deck a spaced distance above the surface of the building girder top flange 15. The second end of the deck is shown supported by the top flange 21 of the shoring beam 20, being overlapped by a second deck 13. The two decks are secured together by a strap 34 as best seen in FIG. 3. The shoring beam 20 itself is secured at each end to two shoring girders 18, the shoring beam being positioned at a right angle to the shoring girders, with the shoring girders positioned perpendicular to, and spanning the distance between, the permanent building girders 14 and columns 16. They are similarly secured at their ends to the permanent girders and columns.

Figure 7:
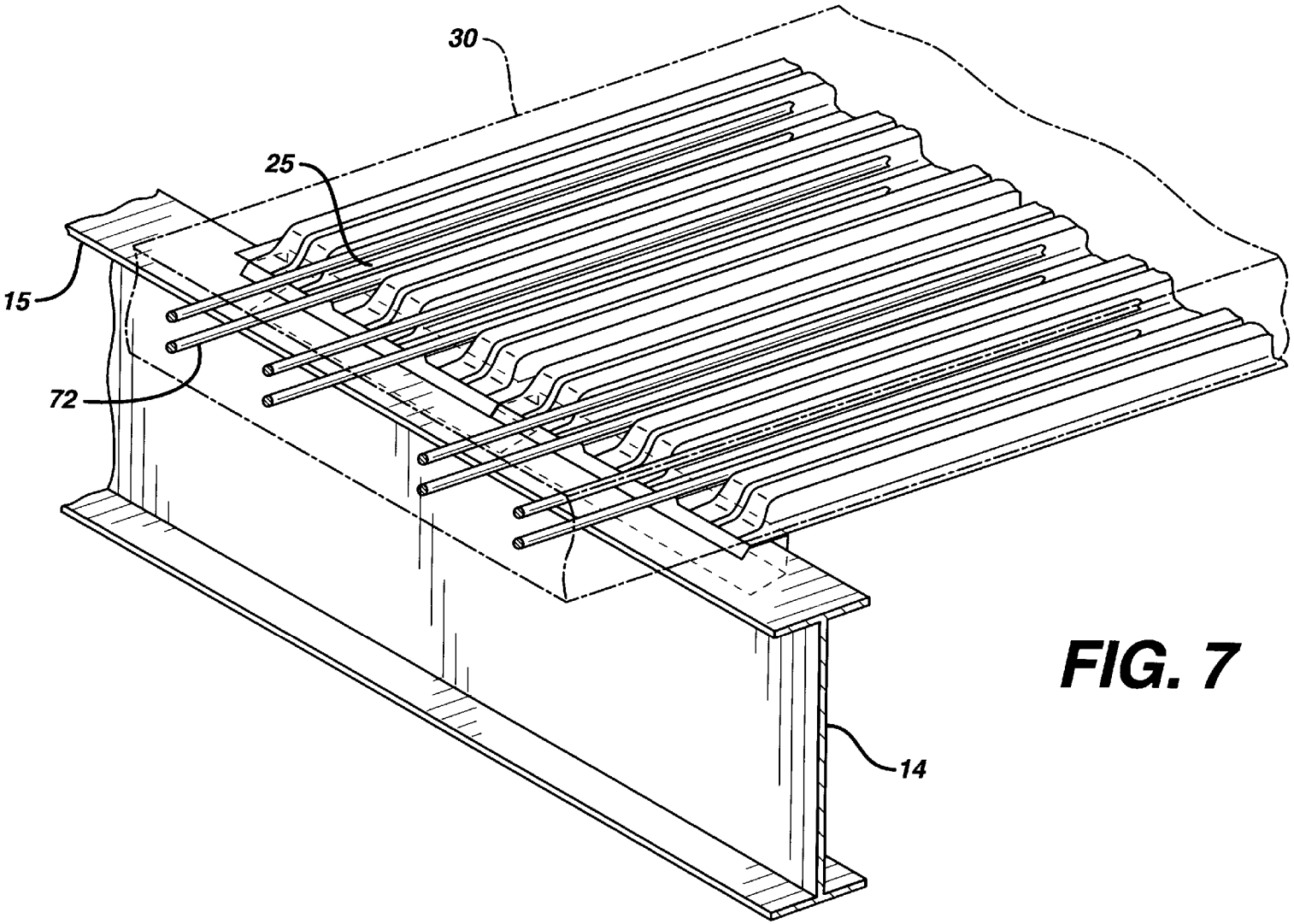
FIG. 7 is a schematic representation of an end portion of a concrete slab supported by the removable support structure of one version of the invention, illustrating the placement of post tensioning steel tendons within the furrows of the corrugated decks.

FIG. 7 illustrates a unique advantage of the structure and method of the invention for those applications in which steel tendons 72 are employed to post tension a concrete slab. When corrugated decks are placed parallel to the permanent building girders and columns, as is typically the case in prior technology, the steel tendons, which need to be placed perpendicular to the permanent girders and columns, can only be placed above the furrows of the decks. Since the present invention calls for the placement of the decks perpendicular to the building girders and columns, it is now possible to place steel tendons within the furrows in the decking thus providing the same strength with a thinner deck! The removable support structure of the present invention utilizing the latch engaging means provides a technique for enhancing the post- tensioning ability of the system. Referring to FIG. 1, by way of illustration a pair of shoring girders 14A and 18A are shown disposed between a respective pair of building columns 16. Permanent girders 14 are secured to the columns 16 and run perpendicular to the shoring girders. The ends of intermediary shoring girder 18 engage the web portions of respective girders 14 employing the latching device described. Intermediary, shoring beams 20 are disposed between 14A and 18, and between 18 and 18A. They are removably secured to the shoring girders, again, by means of the latch device set out above. Disposed between the permanent girders 14 and the shoring beams 20 are deck members 12 and 13 which span the entire area. The vertical distance between the top flange of the shoring beams 20 and the underside of the deck members 12 and 13, can be varied by adjusting the nut 44 securing the latch column 42 on the latch mechanism at each end of a typical shoulder beam 20. Thus the vertical distance at the shoring beams can be made greater than the vertical spacing of the shoe end of the deck plates at respective girders 14, thus increasing the thickness of the concrete deck at the center, above the shoring beams 20. As such, when the concrete hardens, the post-tensioning effect is enhanced thereby increasing the structural strength of the deck. The thickness at the shoring beams 20 can also be reduced using additional layers of plywood or raising the location of the latch support openings 54 in the shoring girders 14A, 18, 18A, etc.

After the wet concrete has been poured and then permitted to harden, and the post-tensioning effected, the weight of the system is now supported by the permanent structure. The removable support structure 70 is now taken down with heretofore unobtainable ease and convenience, ready for re-use. The temporary bolts 66 are removed from the bolt holes in the beam, building girder or column and the front plate of the latch enclosure. The nut 44 securing the latch column 42 within the opening 54 in the building girder, beam or column, is simply lowered and the bolt within bolt hole 48 is removed. The shoring girder or beam is raised slightly to free the latch. The shoring girder or beam is now free to be moved to the right or left for easy removal. Similar actions at each shoring girder or beam, latch mechanism release these support structures for rapid removal. The straps at the open end of the decks can now be grasped and pulled downward to facilitate the downward motion of the bearing shoes 23 at the building girder or column supported ends of the decks. This motion causes the bearing shoes to break clear of the concrete at the supported end of the deck, with the complete corrugated deck now being free of the concrete slab, in condition for re-use.

While the present invention has been disclosed in connection with versions shown and described in detail, various modifications and improvements will become readily apparent to those skilled in the art. Accordingly, the spirit and scope of the present invention is to be limited only by the following claims.

What is claimed is:

1. A removable support structure for supporting a wet concrete pour and cure during concrete slab construction, said slab disposed between permanently disposed building girders and columns, said removable support structure comprising:

(a) shoring girders, each said shoring girder having a first and second end;

(b) first latch engaging means, said first latch engaging means for removably engaging at least one of said first and second ends of each said shoring girder to a respective first one of either said building girders or columns, said shoring girders for extending from said respective first one of either said building girders or columns to a respective second one of either said building girders or columns, to which said second end of said shoring girder is to be engaged, each said first latch engaging means including means for adjustably raising and lowering a respective first or second end of said respective shoring girder;

(c) shoring beams, each said shoring beam having a third and fourth end;

(d) second latch engaging means, said second latch engaging means for removably engaging at least one of said third and fourth ends of each said shoring beam to a respective shoring girder, each said second latch engaging means including means for adjustably raising and lowering a respective third or fourth end of said respective shoring beam;

(e) a plurality of deck members for supporting the wet concrete until it hardens, each of said deck members for being positioned between said respective first one of either said building girders or columns and said respective shoring beam, or between said respective shoring beam and said respective second one of either said building girders or columns, each said deck member having a fifth and sixth end, each said deck member for being supported at said fifth end by said respective first or second one of said building girders or columns and at said sixth end by said respective shoring beam; and (f) first cooperating means for being disposed between said fifth end of each said deck member and said respective first or second one of said building girders or columns and for detachably engaging said fifth end to said respective first or second one of said building girders or columns each said first cooperating means for detachably engaging including means for permitting rotation of said respective deck member downward, to facilitate removal of each said deck member; and, (g) second cooperating means disposed at said sixth end of each said deck member, said second cooperating means including means cooperatively engaging each said sixth end of respective deck members, said second cooperating means further including means utilized by an operator to initiate downward rotational movement of each said deck member at said sixth end, to facilitate removal of said sixth end from the concrete after it hardens;

said first and second latch engaging means and said first and second cooperating means permitting rapid engagement and/or subsequent rapid removal of the elements of said support structure, before the pouring of the wet concrete and after the hardening thereof, respectively, and thereafter them reuse of said support structure elements to support a subsequent concrete slab construction.

2. The removable support structure claimed in claim 1 wherein the elements comprising said support structure are adapted to be disposed substantially in a plane defined by the respective first and second one of said building girders to which said shoring girders are to be engaged by said first latch engaging means.

3. The removable support structure system claimed in claim 1 wherein said deck members are corrugated in that they have alternating high segments and furrows.

4. The removable support structure claimed in claim 1 wherein said first and second latch engaging means include a respective latch mechanism adapted to engage means for supportingly, accommodating said respective latch mechanism to be disposed said respective first or second one of said building girders, columns or said respective shoring girder.

5. The removable support structure claimed in claim 4 wherein each said respective latch mechanism includes a box like structure for supporting said latch mechanism being affixed to at least one end of each of said shoring girders and shoring beams.

6. The removable support structure claimed in claim 5 wherein said box like structure is comprised of a front plate, laterally extending left and right side plates, and a slotted base plate, said front plate having means for securing said front plate to said means for supportingly, accommodating said respective latch mechanism, each said respective latch mechanism comprised of a latch having an attached threaded latch column with a threaded nut threadingly, engaging said threaded latch column, said latch being positioned above said front plate and said left and right side plates with said attached threaded latch column extending vertically downward through said slot in said base plate with said nut being affixed to said threaded column on a length of said column positioned below said base plate slot, so that when said latch is connected to a pre-cut opening in said means for supportingly, accommodating said respective latch mechanism, said nut is threaded upwards on said column, thereby securing said latch to said means for accommodating said respective latch mechanism, and when it is desired to release said shoring girders and said shoring beams from said concrete slab construction said nut is threaded downwards on said column, thereby releasing said latch for removal from said shoring support member.

7. The removable support structure claimed in claim 1 wherein said first cooperating means comprises a respective bearing shoe being affixed to said fifth end of a first deck member to be supported by said respective first one of either said building girders or columns, with the sixth end of said first deck member being supported on a top surface of said respective shoring beam, said sixth end of said first deck member overlapping a sixth end of a second deck member, said first and said second deck members being secured together by at least one strap, a respective bearing shoe affixed to said fifth end of said second deck member and for being supported by said respective second one of either said building girders or columns, so that in addition to said first and second decks being firmly and accurately secured together, said at least one strap cooperates with each said bearing shoe to firmly and accurately engage said bearing shoe against an extending edge of a top flange or plate of its said respective first or second one of said supporting building girders or columns.

8. The removable support structure claimed in claim 7 wherein said bearing shoe comprises a channel affixed along the width of said fifth end of each said deck member to be supported by said respective first or second one of said building girders or columns, said channel for engaging said extending edge of said top flange or plate of said respective first or second one of said building girders or columns when said deck member is positioned between said respective first or second one of said building girders or columns and said shoring beam.

9. The removable support structure claimed in claim 7 wherein said at least one strap additionally engages a top surface of said respective shoring beam.

10. The removable support structure claimed in claim 3, further comprising steel tendons, said steel tendons being placed along the length of said decks, and, within said furrows in said corrugated deck members prior to the pouring of concrete.

11. A removable support structure for supporting wet concrete between permanently positioned building girders and columns during concrete slab construction, comprising:

shoring girders having a latch mechanism at both ends of each of said shoring girders, said latch mechanism comprising a box like structure affixed at each of said ends of said shoring girders, said box like structure securing a vertically and laterally adjustable latch, each of said shoring girders for extending from a respective first one of either said building girders or columns to a respective second one of either said building girders or columns, said latches at said ends of each said shoring girder for engaging respective pre-cut openings in side walls of said building girders or said columns, each said shoring for girders being secured at a substantially right angle to said respective first one of either said building girders or columns and said respective second one of either said building girders or columns, each said latch mechanism including means for adjustable raising and lowering said shoring girders, as required;

shoring beams having said latch mechanism, including respective latches, affixed at each end of said shoring beams, said shoring beams being positioned between and at a substantially right angle to said shoring girders, said latches at said ends of each said shoring beam for engaging pre-cut openings in side walls of said shoring girders, each said shoring beam latch mechanism including means for adjustable raising and lowering said shoring beams, as required;

corrugated deck members for being supported by a respective said building girder or column and a respective said shoring beam, at least two of said deck members having closed upraised ridge portions at respective ends of said deck members which are for being supported on said respective building girder or column, said building girder or column supported deck member end being further modified with a channel affixed thereto along the width thereof so as to firmly encompass an extending edge of a top flange or plate of said building girder or column, said at least two said deck members having open, upraised ridge portions at their respective other ends supported by a respective said shoring beam, said respective other open, upraised portion deck member ends of said at least two said deck members overlapping each other on a top surface of said respective shoring beam, said overlapping open ends of said deck members being removably secured together by at least one strap, said strap cooperating with said channels on said deck members so as to firmly and accurately secure said deck members in a manner to resist movement due to workers and the elements prior to pouring of said wet concrete onto the top surface of said corrugated deck members;

said shoring girders, shoring beams, and corrugated deck members being removed in re-usable condition from said concrete slab construction after said concrete has hardened by adjusting said latches upwards in said pre-cut openings, enabling removal of said shoring girders and said shoring beams from said hardened concrete, and bending said at least one strap on said shoring beam supported ends of said deck members, downward, enabling removal of said deck members by rocking said deck members in a downward direction.

12. The removable support structure claimed in claim 11, further comprising steel tendons, said steel tendons being placed along the length of said deck members within the furrows in said deck members.

13. A method for providing a removable support structure for concrete slab construction, comprising the steps of:

(a) securing shoring girders at right angles to oppositely positioned permanent building wall supports making use of vertically and laterally adjustable latches affixed at both ends of each of said shoring girders for engagement of pre-cut openings in said wall supports;

(b) securing respective shoring beams to said shoring girders, each of said shoring beams being positioned between and at right angles to two shoring girders, said shoring beams being secured to said shoring girders making use of said vertically and laterally adjustable latches, as affixed to said shoring girders, being affixed at both ends of each of said shoring beams for engagement of pre-cut openings in said shoring girders;

(c) placing corrugated deck members on top surfaces of said wall supports and said shoring beams so as to span an open building area between said wall supports, said corrugated deck members being positioned lengthwise perpendicularly to said wall supports;

(d) securing one end of each of said deck members to at least one other end of another deck member by means of at least one strap, said strap secured deck ends being positioned on said top surface of said shoring beam;

(e) securing an end of said deck members positioned on said top surface of said wall supports to an extending top edge of said wall support top surface making use of a channel affixed along the width of said wall support positioned deck end, said channel engaging said top edge of said top surface of said wall support;

(f) pouring wet concrete onto a top surface of said corrugated decks;

(g) allowing said wet concrete to harden; and (h) removing said shoring girders, said shoring beams, and removing said corrugated deck members by rotating downward said ends of said deck members secured to each other by said at least one strap, said deck members pivoting downward about the end of each said deck member secured to the top surface of said wall support, in re-usable condition after said concrete has hardened.

14. The method according to claim 13, further comprising the step of placing steel tendons along said length of said decks said steel tendons being placed within furrows in said deck members.

* * * * *

UNITED STATES PATENT AND TRADEMARK OFFICE

CERTIFICATE OF CORRECTION

PATENT NO : 5,906,076

DATED : May 25, 1999

INVENTOR(S): Ira J. McManus, Florham Park, New Jersey

It is certified that error appears in the above-identified patent and that said Letters Patent is hereby corrected as shown below:

IN THE CLAIMS: At Column 9, line 63, change the word "them" to --the--.

At Column 10, line 12, add the word --on-- after the word disposed.

At Column 11, line 31, change the word "adjustable" to --adjustably--.

At Column 11, line 40, change the word "adjustable" to --adjustably--.

Signed and Sealed this

Sixteenth Day of November, 1999

*Attest:*

Q. TODD DICKINSON

*Attesting Officer*

*Acting Commissioner of Patents and Trademarks*